US009196404B2

(12) United States Patent
Otsuka et al.

(10) Patent No.: US 9,196,404 B2
(45) Date of Patent: Nov. 24, 2015

(54) SOFT MAGNETIC POWDER, DUST CORE, AND MAGNETIC DEVICE

(71) Applicant: Seiko Epson Corporation, Tokyo (JP)

(72) Inventors: Isamu Otsuka, Hachinohe (JP); Yu Maeda, Hachinohe (JP); Toshikuni Sato, Hachinohe (JP)

(73) Assignee: Seiko Epson Corporation (JP)

( * ) Notice: Subject to any disclaimer, the term of this patent is extended or adjusted under 35 U.S.C. 154(b) by 425 days.

(21) Appl. No.: 13/852,270

(22) Filed: Mar. 28, 2013

(65) Prior Publication Data

US 2013/0255836 A1 Oct. 3, 2013

(30) Foreign Application Priority Data

Mar. 30, 2012 (JP) ..... 2012-083142

(51) Int. Cl.
*H01F 1/153* (2006.01)
*H01F 3/08* (2006.01)

(52) U.S. Cl.
CPC ..... *H01F 1/15308* (2013.01); *H01F 3/08* (2013.01)

(58) Field of Classification Search
CPC ..... H01F 3/08
USPC ..... 148/304
See application file for complete search history.

(56) References Cited

U.S. PATENT DOCUMENTS 7,425,239 B2 * 9/2008 Ogawa et al. ..... 148/304
8,083,867 B2 12/2011 Yoshizawa et al.

FOREIGN PATENT DOCUMENTS

JP 2002-060914 2/2002
JP 2007-182594 7/2007
JP 2008-282929 11/2008

* cited by examiner

*Primary Examiner* — Jessee Roe
(74) *Attorney, Agent, or Firm* — Harness, Dickey & Pierce, P.L.C.

(57) ABSTRACT

A soft magnetic powder containing an amorphous alloy material having an alloy composition represented by $Fe_{100-a-b-c-d}Mn_aSi_bB_cC_d$ wherein a, b, c and d each represent a proportion in terms of percent by atom, and satisfy $0.1 \leq a \leq 10$, $3 \leq b \leq 15$, $3 \leq c \leq 15$, and $0.1 \leq d \leq 3$.

9 Claims, 3 Drawing Sheets

SOFT MAGNETIC POWDER, DUST CORE, AND MAGNETIC DEVICE

BACKGROUND

1. Technical Field

The present invention relates to a soft magnetic powder, a dust core, and a magnetic device.

2. Related Art

In recent years, mobile devices, such as notebook computers, are markedly reduced in size and weight. Furthermore, notebook computers in recent years have capabilities that are enhanced and equivalent to desktop computers.

For the reduction of size and weight and the enhancement of the capabilities of mobile devices, it is necessary to provide a switching power supply driven at a high frequency. Accordingly, the driving frequency of the switching power supply has now been increased to several hundred kHz, and associated therewith, the driving frequency of the magnetic devices, such as a choke coil and an inductor included in a mobile device, is also necessarily increased.

For example, JP-A-2007-182594 discloses a thin strip formed of an amorphous alloy containing Fe, M (wherein M represents at least one element selected from Ti, V, Zr, Nb, Mo, Hf, Ta and W), Si, B and C, and also discloses a magnetic core produced by laminating the thin strips and punching out the laminated thin strips. The magnetic core is expected to enhance alternating current magnetic characteristics.

However, the magnetic core formed with the thin strips necessarily suffers considerable increase of Joule loss (eddy current loss) due to the eddy current as the driving frequency of the magnetic device is further increased.

For solving these problems, a dust core has been used, which is formed by press molding a mixture of a soft magnetic powder and a binder.

A soft magnetic powder constituted by an amorphous alloy material has a large resistivity, and thus the eddy current loss is suppressed in a magnetic core containing the soft magnetic powder. As a result, the iron loss at a high frequency can be lowered. In particular, an Fe-based amorphous alloy has a large saturation magnetic flux density, and thus is useful as a soft magnetic material for a magnetic device.

However, the Fe-based amorphous alloy has a large magnetostriction and thus has a problem that it generates heat at a particular frequency, and enhancement of the magnetic characteristics (for example, reduction of coercive force and increase of magnetic permeability) is prevented.

SUMMARY

An advantage of some aspects of the invention is to provide a soft magnetic powder that achieves both reduction of iron loss and enhancement of the magnetic characteristics of a magnetic core, a dust core produced with the soft magnetic powder, and a magnetic device containing the dust core.

An aspect of the invention is directed to a soft magnetic powder that contains an amorphous alloy material having an alloy composition represented by $Fe_{100-a-b-c-d}Mn_aSi_bB_cC_d$ wherein a, b, c and d each represent a proportion in terms of percent by atom, and satisfy $0.1 \le a \le 10$, $3 \le b \le 15$, $3 \le c \le 15$, and $0.1 \le d \le 3$.

According to this aspect, the magnetostriction of the amorphous alloy material can be reduced, thereby providing a soft magnetic powder that achieves both reduction of iron loss and enhancement of the magnetic characteristics on using as a magnetic core.

In the soft magnetic powder of the aspect of the invention, it is preferable that the amorphous alloy material satisfies relationship $0.05 \le c/(a+b) \le 1.5$.

According to this configuration, the melting point of the amorphous alloy material can definitely be decreased by the addition of B, without impairing the enhancement of the magnetic characteristics.

In the soft magnetic powder of the aspect of the invention, it is preferable that the amorphous alloy material satisfies relationship $6 \le b+c \le 30$.

According to this configuration, both reduction of iron loss and enhancement of the magnetic characteristics of the amorphous alloy material can be achieved at a high level, without a remarkable decrease of the saturation magnetic flux density.

In the soft magnetic powder of the aspect of the invention, it is preferable that the amorphous alloy material satisfies relationship $0.01 \le d/(a+b) \le 0.3$.

According to this configuration, the amorphous alloy material may definitely be made amorphous, and the soft magnetic powder can definitely be made spherical, with the excellent magnetic characteristics maintained.

In the soft magnetic powder of the aspect of the invention, it is preferable that the soft magnetic powder has an average particle diameter of from 3 to 100 μm.

According to this configuration, the path through which the eddy current flows can be shortened, thereby providing a dust core that is sufficiently suppressed in the eddy current loss.

In the soft magnetic powder of the aspect of the invention, it is preferable that the soft magnetic powder has a coercive force of 4 Oe or less.

According to this configuration, the hysteresis loss can definitely be suppressed, and the iron loss may definitely be lowered.

In the soft magnetic powder of the aspect of the invention, it is preferable that the soft magnetic powder has an oxygen content of from 150 to 3,000 ppm in terms of mass ratio.

According to this configuration, the soft magnetic powder can achieve all the iron loss, the magnetic characteristics and the weather resistance at a high level.

Another aspect of the invention is directed to a dust core that contains a soft magnetic powder containing an amorphous alloy material having an alloy composition represented by $Fe_{100-a-b-c-d}Mn_aSi_bB_cC_d$, wherein a, b, c and d each represent a proportion in terms of percent by atom, and satisfy $0.1 \le a \le 10$, $3 \le b \le 15$, $3 \le c \le 15$, and $0.1 \le d \le 3$.

According to this aspect, a dust core can be provided that achieves both reduction of iron loss and enhancement of the magnetic characteristics at a high level.

Still another aspect of the invention is directed to a magnetic device that contains the dust core according to the aspect of the invention.

According to this aspect, a magnetic device that has a small size and high capability may be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
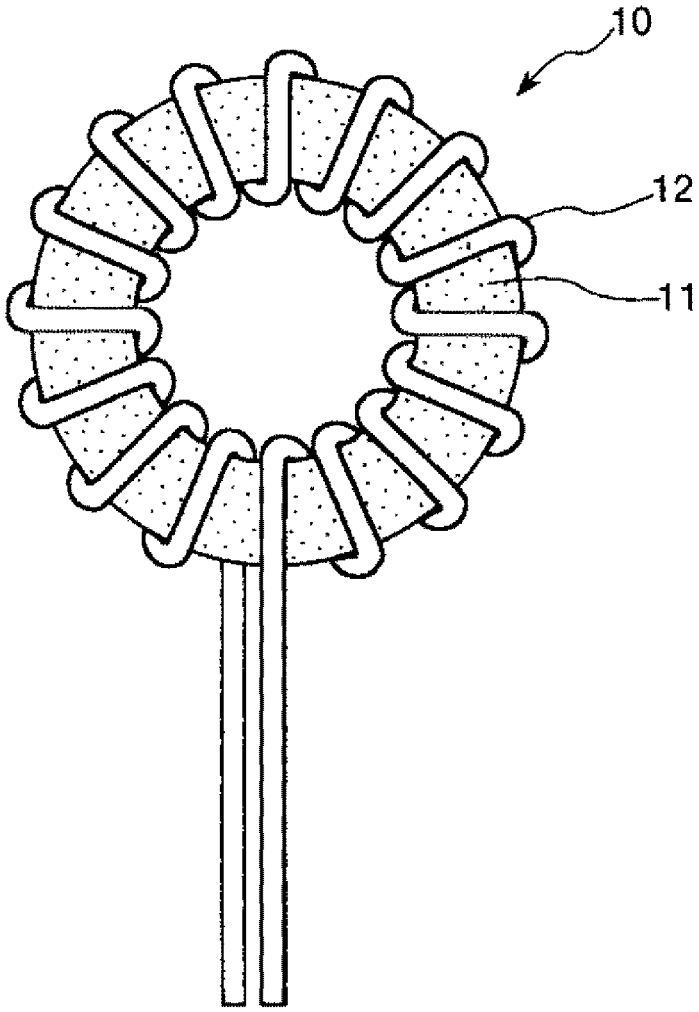
FIG. 1 is a schematic illustration (plan view) showing a choke coil according to a first embodiment of a magnetic device of the invention.

Preferred exemplary embodiments of a soft magnetic powder, a dust core and a magnetic device according to the invention will be described with reference to the accompanied drawings.

Soft Magnetic Powder

The soft magnetic powder according to one embodiment of the invention contains an amorphous alloy material having an alloy composition represented by $Fe_{100-a-b-c-d}Mn_aSi_bB_cC_d$ wherein a, b, c and d each represent a proportion in terms of percent by atom, and satisfy $0.1 \le a \le 10$, $3 \le b \le 15$, $3 \le c \le 15$, and $0.1 \le d \le 3$.

The soft magnetic powder is an Fe-based amorphous alloy powder and thus has a small eddy current loss and a large saturation magnetic flux density, and furthermore the soft magnetic powder contains Mn and thus has a low coercive force and a large magnetic permeability. Accordingly, the use of the soft magnetic powder may provide a dust core that has a small iron loss at a high frequency and can be easily reduced in size.

The soft magnetic powder according to the embodiment of the invention will be described in detail below.

The soft magnetic powder is constituted by an amorphous alloy material having an alloy composition represented by $Fe_{100-a-b-c-d}Mn_aSi_bB_cC_d$, wherein a, b, c and d each represent a proportion in terms of percent by atom, and a, b, c and d satisfy $0.1 \le a \le 10$, $3 \le b \le 15$, $3 \le c \le 15$, and $0.1 \le d \le 3$, as described above.

Among these elements, Mn (manganese) has a function of reducing the magnetostriction of the amorphous alloy material. The reduction of the magnetostriction brings about a reduction of the coercive force. Accordingly, the hysteresis loss is reduced, and the iron loss is reduced, which are advantageous for reducing iron loss in the high frequency range. The magnetic permeability is increased with the reduction of the magnetostriction, thereby enhancing the responsiveness to the external magnetic field.

Although the cause of the phenomenon is not completely clear, it is believed that since the atomic size of Mn is very close to the atomic size of Fe, and an Fe atom may be easily replaced by an Mn atom, the presence of a certain amount of Mn atoms relatively easily reduces the magnetostriction without disturbing the atomic arrangement of the amorphous material. Accordingly, the coercive force is reduced, and the magnetic permeability is increased. However, the addition of Mn in an excessive amount may cause a reduction of the saturation magnetic flux density, and it is thus important to determine the magnetic flux density with the addition amount of Mn.

Mn is liable to be oxidized as compared to Si, and thus manganese oxide is deposited on the surface of the soft magnetic powder during the production thereof. Manganese oxide is liable to be deposited so as to be dotted on the surface of the particles, and it is considered that an oxide of an element that is easily oxidizable next to Mn (for example, silicon oxide or the like) is deposited to fill the gaps among the dotted manganese oxide. Thus, the surface of the particles is covered with a discontinuous deposit formed of oxides having different compositions, and thus the insulating property on the surface of the particles is increased, thereby enhancing the interparticle resistance. Accordingly, a soft magnetic powder is obtained that is capable of producing a dust core having a large magnetic flux density, a large magnetic permeability and a small eddy current loss.

The content a of Mn in the amorphous alloy material satisfies the relationship $0.1 \le a \le 10$. When the content a of Mn is lower than the lower limit, the magnetostriction is lowered only by a limited extent, and thus it fails to achieve both reduction of iron loss and enhancement of the magnetic characteristics. When the content a of Mn exceeds the upper limit, the formation of the amorphous material is impaired, the saturation magnetic flux density is lowered, and thus it fails to achieve both reduction of iron loss and enhancement of the magnetic characteristics.

The content a of Mn preferably satisfies the relationship $0.5 \le a \le 9$, more preferably the relationship $0.7 \le a \le 8.5$, and even more preferably the relationship $1 \le a \le 8$.

Among the elements, Si (silicon) contributes to the enhancement of the magnetic permeability of the amorphous alloy material. The addition of the particular amount of Si may increase the resistivity of the amorphous alloy material, and thus the eddy current loss of the soft magnetic powder may be suppressed. Furthermore, the addition of the particular amount of Si also lowers the coercive force.

The content b of Si in the amorphous alloy material satisfies the relationship $3 \le b \le 15$. When the content b of Si is less than the lower limit, the magnetic permeability and the resistivity of the amorphous alloy material are not sufficiently increased, and enhancement of responsiveness to the external magnetic field and reduction of eddy current loss are not sufficiently achieved. When the content b of Si exceeds the upper limit, the formation of the amorphous material is impaired, the saturation magnetic flux density is lowered, and thus it fails to achieve both reduction of iron loss and enhancement of the magnetic characteristics.

The content b of Si preferably satisfies the relationship $4.5 \le b \le 13$, more preferably the relationship $5.5 \le b \le 12.5$, and even more preferably the relationship $6 \le b \le 11.5$.

Among the elements, B (boron) lowers the melting point of the amorphous alloy material and facilitates formation of the amorphous material. Accordingly, the resistivity of the amorphous alloy material may be increased, and the eddy current loss of the soft magnetic powder may be suppressed.

The content c of B in the amorphous alloy material satisfies the relationship $3 \le c \le 15$. When the content c of B is less than the lower limit, the melting point of the amorphous alloy material is not sufficiently lowered, thereby failing to form the amorphous material. When the content c of B exceeds the upper limit, the melting point of the amorphous alloy material is not sufficiently lowered, thereby failing to form the amorphous material and lowering the saturation magnetic flux density.

The content c of B preferably satisfies the relationship $4.5 \le c \le 13$, more preferably the relationship $5.5 \le c \le 12.5$, and even more preferably the relationship $6.5 \le c \le 11.5$.

Among the elements, C (carbon) lowers the viscosity of the amorphous alloy material on melting and facilitates formation of the amorphous material and formation of the powder. Accordingly, the resistivity of the amorphous alloy material may be increased, and the sphericity of the soft magnetic powder may be increased. When a dust core is produced with the soft magnetic powder, the distances among the particles are reduced, thereby increasing the packing factor. Furthermore, a soft magnetic powder having a uniform particle diameter and a soft magnetic powder having a smaller diameter may be produced efficiently.

The content d of C in the amorphous alloy material satisfies the relationship $0.1 \le d \le 3$. When the content d of C is less than the lower limit, the viscosity of the amorphous alloy material on melting is too large, and the soft magnetic powder has irregular shapes. Accordingly, the packing factor when producing a dust core may not be sufficiently increased, and the saturation magnetic flux density and the magnetic permeability of the dust core may not be sufficiently increased. When the content d of C exceeds the upper limit, formation of the amorphous material is impaired, and the coercive force is increased.

The content d of C preferably satisfies the relationship $0.5 \leq d \leq 2.8$, more preferably the relationship $0.7 \leq d \leq 2.6$, and even more preferably the relationship $1.2 \leq d \leq 2.5$.

The sum (b+c) of the content b of Si and the content c of B preferably satisfies the relationship $6 \leq b+c \leq 30$, more preferably the relationship $12 \leq b+c \leq 28$, and even more preferably the relationship $15 \leq b+c \leq 25$. When Si and B are added to satisfy the relationship, both reduction of iron loss and enhancement of the magnetic characteristics of the amorphous alloy material can be achieved without a remarkable reduction of the saturation magnetic flux density.

The content b of Si, the content c of B and the content d of C preferably satisfy the relationship $b>c>d$. When this relationship is satisfied, a soft magnetic powder that achieves both reduction of iron loss and enhancement of the magnetic characteristics at a high level may be obtained.

The ratio of the content a of Mn to the sum (b+c) preferably satisfies the relationship $0.01 \leq a/(b+c) \leq 3$, more preferably the relationship $0.03 \leq a/(b+c) \leq 2$, and even more preferably the relationship $0.05 \leq a/(b+c) \leq 1$. When this relationship is satisfied, the reduction of magnetostriction by the addition of Mn and the increase of resistivity with Si and B may be optimized without cancelling them out. As a result, the eddy current loss may be minimized. Furthermore, upon melting the amorphous alloy material, both manganese oxide and silicon oxide are securely deposited in a state where the melting point is low, and the insulating property on the surface of the particles of the soft magnetic powder may definitely be enhanced. Accordingly, a soft magnetic powder may be obtained that definitely provides a dust core having a large magnetic flux density, a large magnetic permeability and a small eddy current loss.

The ratio of the content c of B to the sum (a+b) of the content a of Mn and the content b of Si preferably satisfies the relationship $0.05 \leq c/(a+b) \leq 1.5$, more preferably the relationship $0.07 \leq c/(a+b) \leq 1.2$, and even more preferably the relationship $0.1 \leq c/(a+b) \leq 1$. When this relationship is satisfied, the melting point of the amorphous alloy material may definitely be decreased without impairing the enhancement of the magnetic characteristics by the addition of B. Accordingly, a soft magnetic powder may be obtained that definitely provides a dust core having a large magnetic flux density, a large magnetic permeability and a small eddy current loss.

The ratio of the content d of C to the sum (a+b) of the content a of Mn and the content b of Si preferably satisfies the relationship $0.01 \leq d/(a+b) \leq 0.3$, more preferably the relationship $0.02 \leq d/(a+b) \leq 0.25$, and even more preferably the relationship $0.03 \leq d/(a+b) \leq 0.2$. When this relationship is satisfied, formation of the amorphous material for the amorphous alloy material and formation of spherical particles for the soft magnetic powder may definitely be achieved.

The ratio of the content a of Mn to the sum (c+d) of the content c of B and the content d of C preferably satisfies the relationship $0.01 \leq a/(c+d) \leq 1$, more preferably the relationship $0.03 \leq a/(c+d) \leq 0.85$, and even more preferably the relationship $0.05 \leq a/(c+d) \leq 0.7$. When this relationship is satisfied, both the enhancement of the magnetic characteristics and the formation of the amorphous material may be achieved at a high level.

The balance of Mn, Si, B and C is Fe or unavoidable elements.

Fe is the major component of the amorphous alloy material and largely influences the basic magnetic characteristics and mechanical characteristics of the soft magnetic powder.

The unavoidable elements are elements that are unintentionally mixed therein from the raw materials or in the production of the soft magnetic powder. The unavoidable elements are not particularly limited, and examples thereof include O (oxygen), N (nitrogen), P (phosphorus), S (sulfur) and Al (aluminum). The amount of the unavoidable elements mixed varies depending on the raw materials and the production method and is preferably less than 0.1% by atom, and more preferably 0.05% by atom or less.

The soft magnetic powder according to the embodiment of the invention preferably has an average particle diameter of from 3 to 100 μm, more preferably from 4 to 80 μm, and even more preferably from 5 to 60 μm. The use of the soft magnetic powder having an average particle diameter within this range may shortens the path through which the eddy current flows, thereby providing a dust core with a sufficiently suppressed eddy current loss.

The average particle diameter may be obtained as a particle diameter when the accumulated amount by mass is 50% in a laser diffraction method.

When the average particle diameter of the soft magnetic powder is smaller than the lower limit, the moldability on compressing and molding the soft magnetic powder may be deteriorated, which results in a reduction of the density of the resulting dust core and may also result in a reduction of the saturation magnetic flux density and the magnetic permeability thereof. When the average particle diameter of the soft magnetic powder is larger than the upper limit, the path in the dust core through which the eddy current flows, may be increased, which may result in an increase of the eddy current loss.

The particle size distribution of the soft magnetic powder is preferably as narrow as possible. Specifically, when the average particle diameter of the soft magnetic powder is in the aforementioned range, the maximum particle diameter is preferably 200 μm or less, and more preferably 150 μm or less. When the maximum particle diameter of the soft magnetic powder is controlled to this range, the particle size distribution of the soft magnetic powder may be narrower, thereby solving the problem that the eddy current loss is locally increased.

The maximum particle diameter herein is a particle diameter when the accumulated amount by mass is 99.9%.

The average value of the aspect ratio of the soft magnetic powder, which is defined by S/L, wherein S (μm) represents the minor diameter of the particles of the soft magnetic powder, and L (μm) represents the major diameter thereof, is preferably approximately from 0.4 to 1, and more preferably approximately from 0.7 to 1. The soft magnetic powder having an aspect ratio within this range has a shape that is relatively close to a spherical shape, and thus the packing factor when molding the powder may be increased. As a result, a dust core having a large saturation magnetic flux density and a large magnetic permeability may be obtained.

The major diameter herein is the maximum length on the projected image of the particles, and the minor diameter herein is the maximum length in the direction perpendicular to the major diameter.

The soft magnetic powder according to the embodiment of the invention preferably has an apparent density of 3 g/cm$^3$ or more, and more preferably 3.5 g/cm$^3$ or more. When a dust core is produced with the soft magnetic powder that has such a large apparent density, the packing factor of the particles may be increased, thereby providing a dust core having a particularly large density. Consequently, a dust core having a particularly large magnetic permeability and a particularly large magnetic flux density may be obtained.

The apparent density herein is a value that is measured according to the method disclosed in JIS 22504.

The soft magnetic powder according to the embodiment of the invention has the alloy composition mentioned above and thus preferably has a reduced coercive force of 4 Oe (318 A/m) or less, and more preferably 1.5 Oe (119 A/m) or less. When the coercive force is reduced to this range, the hysteresis loss may definitely be suppressed, and the iron loss may definitely be lowered.

The saturation magnetic flux density of the soft magnetic powder is preferably as large as possible, and is preferably 0.8 T or more, and more preferably 1.0 T or more. When the saturation magnetic flux density of the soft magnetic powder is in this range, the dust core may be sufficiently reduced in size without impairing the capabilities thereof.

The soft magnetic powder according to the embodiment of the invention preferably has an oxygen content of from 150 to 3,000 ppm by mass, more preferably from 200 to 2,500 ppm by mass, and even more preferably from 200 to 1,500 ppm by mass. When the oxygen content is suppressed to this range, the soft magnetic powder may achieve the demands on all the iron loss, the magnetic characteristics and the weather resistance at a high level. Specifically, when the oxygen content is smaller than the lower limit, the interparticle resistance of the soft magnetic powder may be reduced, and the iron loss thereof may be increased, for example, due to the failure to form an oxide film having a suitable thickness on the particles of the soft magnetic powder. When the oxygen content is larger than the upper limit, the thickness of the oxide film may be too large, and the magnetic characteristics may be correspondingly deteriorated.

The oxygen content in the magnetic powder may be measured, for example, with an atomic absorption spectrometer, an ICP emission spectrophotometer or an oxygen-nitrogen analyzer.

The soft magnetic powder may be produced by various powder formation methods, for example, an atomizing method (such as a water atomizing method, a gas atomizing method and a spinning water atomizing method), a reducing method, a carbonyl method and a pulverizing method.

Among these, the soft magnetic powder according to the embodiment of the invention is preferably one that is produced by an atomizing method, and more preferably by a spinning water atomizing method. In the atomizing method, a molten metal is atomized and cooled by making the molten metal collide with a fluid (i.e., a liquid or a gas) sprayed at a high speed, thereby producing metal powder (i.e., the soft magnetic powder). The soft magnetic powder as considerably fine powder may be produced efficiently by the atomizing method. The particle shape of the resulting powder is close to a spherical shape due to the surface tension, and thus a dust core with a high packing factor may be produced therewith. Accordingly, a soft magnetic powder that is capable of producing a dust core having a large magnetic permeability and a large saturation magnetic flux density may be obtained.

In the case where a water atomizing method is used as the atomizing method, the pressure of the atomizing water to be sprayed is not particularly limited, and is preferably approximately from 75 to 120 MPa (from 750 to 1,200 kgf/cm$^2$), and more preferably approximately from 90 to 120 MPa (from 900 to 1,200 kgf/cm$^2$).

The temperature of the atomizing water is also not particularly limited, and is preferably approximately from 1 to 20° C.

The atomizing water may be sprayed in the form of a circular cone having a vertex in the course of the falling path of the molten metal with the outer diameter thereof being gradually decreased downward. The vertex angle θ of the circular cone formed with the atomizing water is preferably approximately from 10 to 40°, and more preferably approximately from 15 to 35°. In this case, the soft magnetic powder having the aforementioned composition may certainly be produced.

The molten metal may be cooled especially rapidly by the water atomizing method (particularly the spinning water atomizing method), and thus a soft magnetic powder having a large amorphous degree may be produced over a wide range of the alloy composition.

The cooling rate on cooling the molten metal in the atomizing method is preferably $1\times10^{4}$° C./s or more, and more preferably $1\times10^{5}$° C./s or more. By employing the high cooling rate, the molten metal may be solidified while maintaining the atomic arrangement in the molten metal state, i.e., the state where all kinds of atoms are homogeneously mixed, thereby providing a soft magnetic powder having a particularly large amorphous degree with suppressed fluctuation in the composition among the particles of the soft magnetic powder. Consequently, a homogeneous soft magnetic powder having excellent magnetic characteristics may be obtained.

The soft magnetic powder constituted by the amorphous alloy material is preferably subjected to an annealing treatment. The heating condition in the annealing treatment is preferably a temperature of Tx-250° C. or more (where Tx represents the crystallization temperature of the amorphous alloy material) and less than Tx, and a period of from 5 to 120 minutes, and more preferably a temperature of Tx-100° C. or more and less than Tx, and a period of from 10 to 60 minutes. When the annealing treatment is performed under this heating condition, the soft magnetic powder constituted by the amorphous alloy material is annealed, thereby relaxing the remaining stress caused by rapid cooling for solidification in the production of the powder. Accordingly, the distortion of the amorphous soft magnetic powder associated with the remaining stress may be relaxed, thereby enhancing the magnetic characteristics.

The soft magnetic powder thus obtained may be classified as desired. Examples of the method for classification include dry classification, such as sieve classification, inertial classification and centrifugal classification, and wet classification, such as sedimentation classification.

The soft magnetic powder thus obtained may be granulated as desired.

Dust Core and Magnetic Device

The magnetic device according to the embodiment of the invention may be applied to various magnetic devices equipped with a magnetic core, such as a choke coil, an inductor, a noise filter, a reactor, a transformer, a motor and a generator. The dust core according to the embodiment of the invention may be applied to the magnetic cores of the magnetic devices.

As examples of the magnetic device, two kinds of a choke coils will be described below.

First Embodiment

A choke coil according to a first embodiment of the magnetic device of the invention will now be described.

FIG. 1 is a schematic illustration (plan view) showing a choke coil according to the first embodiment of the magnetic device of the invention.

The choke coil 10 shown in FIG. 1 has a dust core 11 in the form of a ring (i.e., a toroidal shape) and a conductive wire 12 wound on the dust core 11. The choke coil 10 is generally referred to as a toroidal coil.

The dust core 11 is obtained in such a manner that the soft magnetic powder according to the embodiment of the invention is mixed with a binder and an organic solvent, and the resulting mixture is fed to a mold and molded under pressure.

Examples of the constitutional material of the binder used for producing the dust core 11 include an organic binder, such as a silicone resin, an epoxy resin, a phenol resin, a polyamide resin, a polyimide resin and a polyphenylene sulfide resin, and an inorganic binder, such as a phosphate salt, e.g., magnesium phosphate, calcium phosphate, zinc phosphate, manganese phosphate and cadmium phosphate, and a silicate salt (water glass), such as sodium silicate, and in particular, a thermosetting polyimide resin and an epoxy resin are preferred. The resin materials are easily solidified by heating and are excellent in heat resistance. Accordingly, the use thereof may enhance the productivity and the heat resistance of the dust core 11.

The proportion of the binder to the soft magnetic powder is preferably from 0.5 to 5% by mass, and more preferably from 1 to 3% by mass, while it varies slightly depending on the target magnetic flux density and the desired allowable eddy current loss of the dust core 11 to be produced. When the proportion of the binder is in this range, the particles of the soft magnetic powder are definitely insulated from each other, whereas the density of the dust core 11 is certainly ensured, thereby preventing the magnetic permeability of the dust core 11 from being markedly decreased. Consequently, the dust core 11 may be provided with a large magnetic permeability and a small loss.

The organic solvent is not particularly limited so long as it can dissolve the binder, and examples thereof include various solvent, such as toluene, isopropyl alcohol, acetone, methyl ethyl ketone, chloroform and ethyl acetate.

The mixture may further contain various additives for arbitrary purposes as desired.

The surface of the soft magnetic powder is covered with the binder. Accordingly, the particles of the soft magnetic powder are insulated from each other with the insulating binder, and thus even when a magnetic field changing at a high frequency is applied to the dust core 11, the induced current associated with the electromotive force generated through the electromagnetic induction caused by the magnetic variation influences only a relatively narrow region in the particles. Accordingly, the Joule loss due to the induced current may be suppressed.

The Joule loss causes heating of the dust core 11, and thus the suppression of the Joule loss suppresses the heat generation amount of the choke coil 10.

Examples of the constitutional material of the conductive wire 12 include materials having high conductivity, for example, a metal, such as Cu, Al, Ag, Au and Ni, and an alloy containing the metal.

The conductive wire 12 preferably has an insulating surface layer on the surface thereof. The dust core 11 and the conductive wire 12 may definitely be prevented from suffering short circuit by the surface layer.

Examples of the constitutional material of the surface layer include various kinds of resin materials.

The production method of the choke coil 10 will be described.

The soft magnetic powder according to the embodiment of the invention, the binder and various additives are mixed with the organic solvent, thereby preparing a mixture.

The mixture is then dried to provide a dried body in bulk form, and the dried body is pulverized to provide granulated powder.

The mixture or the granulated powder is then molded to the shape of the dust core to be produced, thereby providing a molded article.

The molding method herein is not particularly limited, and examples thereof include press molding, extrusion molding and injection molding. The shape and dimension of the molded article may be determined in consideration of the shrinkage upon heating the molded article in the subsequent process.

The resulting molded article is then heated for curing the binder, thereby providing the dust core 11. The heating temperature herein varies slightly depending on the composition of the binder or the like, and in the case where the binder is constituted by an organic binder, the heating temperature is preferably approximately from 100 to 500° C., and more preferably approximately from 120 to 250° C. The heating time varies depending on the heating temperature, and is generally approximately from 0.5 to 5 hours.

According to the procedures, the dust core 11 (i.e., the dust core according to the embodiment of the invention) formed by pressing and molding the soft magnetic powder according to the embodiment of the invention and the choke coil 10 (i.e., the magnetic device according to the embodiment of the invention) containing the dust core 11 and the conductive wire 12 wound on the outer periphery of the dust core 11 are provided. The choke coil 10 is excellent in corrosion resistance for a prolonged period of time, and has a small loss (iron loss) in a high frequency range.

The soft magnetic powder according to the embodiment of the invention facilitates the production of the dust core 11 that has excellent magnetic characteristics. Accordingly, an enhancement of the magnetic flux density of the dust core 11, a size reduction, an increase of the rated electric current and a reduction of the generated heat amount of the choke coil 10 associated therewith are easily achieved. Consequently, the high-performance choke coil 10 is provided.

Second Embodiment

A choke coil according to a second embodiment of the magnetic device of the invention will now be described.

Figure 2:
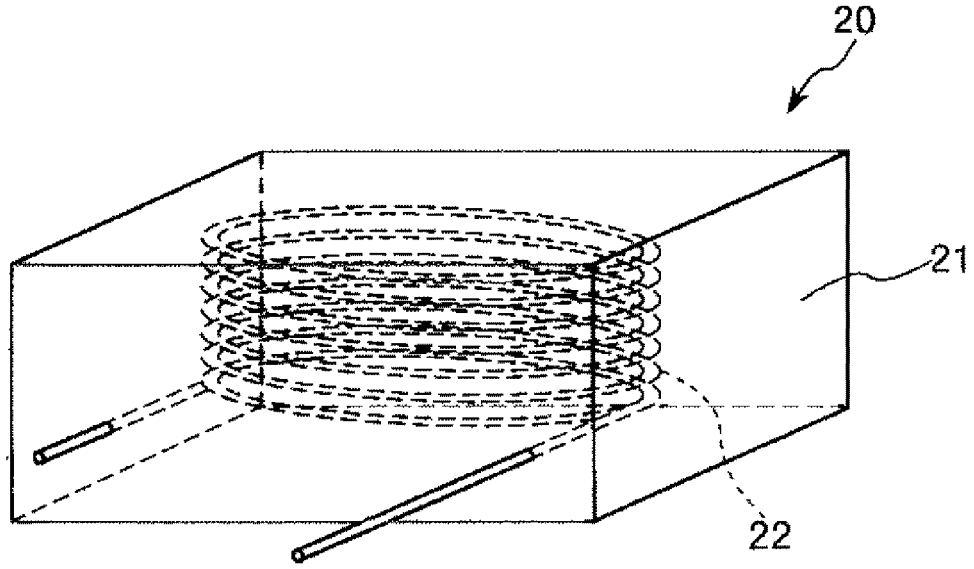
FIG. 2 is a schematic illustration (perspective phantom view) showing a choke coil according to a second embodiment of the magnetic device of the invention.

FIG. 2 is a schematic illustration (perspective phantom view) showing a choke coil according to the second embodiment of the magnetic device of the invention.

While the choke coil according to the second embodiment is to be described below, the differences from the choke coil according to the first embodiment are mainly described, and the common features thereof may be omitted from the description.

The choke coil 20 according to the embodiment as shown in FIG. 2 contains a conductive wire 22 formed into a coil, which is embedded inside a dust core 21. That is, the choke coil 20 contains the conductive wire 22 that is molded with the dust core 21.

The choke coil 20 in this embodiment may be reduced in size relatively easily. In the production of the small-sized choke coil 20, the dust core 21 having a large magnetic permeability, a large magnetic flux density and a small loss exhibits the function and advantages thereof effectively. Specifically, the choke coil 20 with low loss and low heat generation that can be applied to large current can be provided irrespective of the small size thereof.

Furthermore, the conductive wire 22 is embedded inside the dust core 21, and therefore no gap is formed between the conductive wire 22 and the dust core 21. Accordingly, vibration caused by the magnetostriction of the dust core 21 is suppressed, and noise due to the vibration is also suppressed.

In the production of the choke coil 20 according to the embodiment, the conductive wire 22 is disposed in a cavity of a mold, and the cavity is filled with the soft magnetic powder according to the embodiment of the invention. That is, the soft magnetic powder is charged to enclose the conductive wire 22.

Subsequently, the soft magnetic powder is compressed along with the conductive wire 22 to provide a molded article.

The molded article is then subjected to a heat treatment as similar to the first embodiment, and thus the choke coil 20 is provided.

The soft magnetic powder, the dust core and the magnetic device according to the invention have been described with reference to the preferred embodiments, but the invention is not limited thereto.

For example, while the embodiments refer a dust core as an example to which the soft magnetic powder according to the invention is applied, the application thereof is not limited thereto, and examples thereof include other magnetic devices, such as a magnetic fluid, a magnetic shielding sheet and a magnetic head.

Specific examples of the invention will be described below.

1. Production of Dust Core and Choke Coil

Sample No. 1

(1) The raw materials were melted in a high-frequency induction furnace and powderized by a spinning water atomizing method (referred to as SWAP (spinning water atomization process) in the tables), thereby providing a soft magnetic powder. Subsequently, the soft magnetic powder was classified with a standard sieve having a mesh of 150 μm. The alloy composition of the resulting soft magnetic powder is shown in Table 1.

(2) The resulting soft magnetic powder was measured for particle size distribution. The measurement was performed with a laser diffraction particle size distribution analyzer (Microtrack HRA9320-X100, available from Nikkiso Co., Ltd.). The average particle diameter of the soft magnetic powder was obtained from the particle size distribution.

(3) The resulting soft magnetic powder, an epoxy resin (binder) and toluene (organic solvent) were mixed to provide a mixture. The amount of the epoxy resin added was 2 parts by mass per 100 parts by mass of the soft magnetic powder.

(4) The resulting mixture was agitated and dried under heating at a temperature of 60° C. for one hour, thereby providing a dried body in bulk form. The dried body was subjected to a sieve having a mesh of 500 μm, and the dried body was pulverized, thereby providing granulated powder.

(5) The resulting granulated powder was charged in a mold, and a molded article was obtained under the molding condition shown below.

Molding Condition molding method: press molding shape of molded article: ring form dimension of molded article: outer diameter: 28 mm, inner diameter: 14 mm, thickness: 10.5 mm molding pressure: 20 t/cm$^2$ (1.96 GPa)

(6) The molded article was then heated in the air at a temperature of 450° C. for 0.5 hours, thereby curing the binder. Thus, a dust core was obtained.

(7) A choke coil (magnetic device) shown in FIG. 1 was produced by using the resulting dust core under the production condition shown below.

Coil Production Condition constitutional material of conductive wire: Cu diameter of conductive wire: 0.5 mm number of turns (on measuring magnetic permeability): 7 turns number of turns (on measuring iron loss): 30 turns on primary side, 30 turns on secondary side Samples Nos. 2 to 12

Dust cores were produced in the same manner as in Sample No. 1 except that the materials shown in Table 1 were used as the soft magnetic powder, and choke coils were produced by using the dust cores.

TABLE 1

| | | Alloy composition | | | | | | | | | |
|---|---|---|---|---|---|---|---|---|---|---|---|
| | | Mn a | Si b | B c | C d | | | | | | |
| | | % by atom | | | | Fe | b + c | c/(a + b) | d/(a + b) | a/(b + c) | a/(c + d) |
| Sample No. 1 | comparison | 0.00 | 11.08 | 11.49 | 0.00 | 77.4 | 22.57 | 1.037 | 0.000 | 0.000 | 0.000 |
| Sample No. 2 | comparison | 0.00 | 11.05 | 11.05 | 2.15 | 75.8 | 22.10 | 1.001 | 0.194 | 0.000 | 0.000 |
| Sample No. 2a | comparison | 0.00 | 11.01 | 11.14 | 2.07 | 75.8 | 22.15 | 1.012 | 0.188 | 0.000 | 0.000 |
| Sample No. 3 | comparison | 0.04 | 11.37 | 11.62 | 2.55 | 74.4 | 22.98 | 1.018 | 0.223 | 0.002 | 0.003 |
| Sample No. 4 | invention | 0.26 | 10.95 | 10.87 | 2.46 | 75.5 | 21.83 | 0.970 | 0.219 | 0.012 | 0.019 |
| Sample No. 5 | invention | 0.51 | 11.41 | 10.93 | 2.33 | 74.8 | 22.35 | 0.917 | 0.196 | 0.023 | 0.038 |
| Sample No. 6 | invention | 0.77 | 11.15 | 11.13 | 2.10 | 74.9 | 22.28 | 0.934 | 0.177 | 0.034 | 0.058 |
| Sample No. 6a | invention | 0.76 | 11.09 | 11.18 | 2.03 | 74.9 | 22.27 | 0.943 | 0.171 | 0.034 | 0.057 |
| Sample No. 7 | invention | 2.29 | 11.29 | 11.11 | 2.14 | 73.2 | 22.40 | 0.819 | 0.158 | 0.102 | 0.173 |
| Sample No. 7a | invention | 2.27 | 11.32 | 11.03 | 2.18 | 73.20 | 22.35 | 0.811 | 0.160 | 0.102 | 0.172 |
| Sample No. 8 | invention | 4.60 | 11.30 | 11.07 | 2.10 | 70.9 | 22.38 | 0.696 | 0.132 | 0.205 | 0.349 |
| Sample No. 8a | invention | 4.57 | 11.25 | 11.14 | 2.22 | 70.8 | 22.40 | 0.704 | 0.140 | 0.204 | 0.342 |
| Sample No. 9 | invention | 6.83 | 11.37 | 11.02 | 2.10 | 68.7 | 22.39 | 0.606 | 0.115 | 0.305 | 0.520 |
| Sample No. 9a | invention | 6.83 | 11.33 | 10.96 | 2.03 | 68.9 | 22.29 | 0.603 | 0.112 | 0.306 | 0.526 |
| Sample No. 10 | invention | 8.24 | 11.44 | 11.31 | 2.28 | 66.7 | 22.75 | 0.575 | 0.116 | 0.362 | 0.606 |
| Sample No. 11 | invention | 9.82 | 11.19 | 11.13 | 2.25 | 65.6 | 22.33 | 0.530 | 0.107 | 0.440 | 0.733 |
| Sample No. 12 | comparison | 11.37 | 10.58 | 11.94 | 2.62 | 63.5 | 22.52 | 0.544 | 0.119 | 0.505 | 0.781 |

TABLE 1-continued

| | | Atomization method | Average particle diameter μm | Oxygen content ppm | Magnetic permeability μ' 100 kHz | Magnetic permeability μ' 1,000 kHz | Iron loss Bm = 50 mT 100 kHz kW/m³ | Coercive force Oe | Saturation magnetic flux density T |
|---|---|---|---|---|---|---|---|---|---|
| Sample No. 1 | comparison | SWAP | 42.3 | 756 | 58.64 | 56.12 | 212.55 | 1.399 | 1.53 |
| Sample No. 2 | comparison | SWAP | 41.7 | 722 | 66.48 | 64.76 | 209.36 | 1.369 | 1.45 |
| Sample No. 2a | comparison | W-atm | 9.7 | 1,589 | 38.62 | 37.32 | 383.36 | 2.568 | 1.45 |
| Sample No. 3 | comparison | SWAP | 40.2 | 656 | 66.56 | 66.65 | 204.44 | 1.345 | 1.41 |
| Sample No. 4 | invention | SWAP | 32.6 | 497 | 70.12 | 68.79 | 177.23 | 1.154 | 1.39 |
| Sample No. 5 | invention | SWAP | 32.8 | 506 | 70.89 | 69.46 | 170.78 | 1.112 | 1.38 |
| Sample No. 6 | invention | SWAP | 34.0 | 582 | 71.39 | 69.99 | 164.64 | 1.072 | 1.37 |
| Sample No. 6a | invention | W-atm | 10.5 | 1,724 | 39.21 | 38.84 | 354.67 | 1.826 | 1.36 |
| Sample No. 7 | invention | SWAP | 31.3 | 704 | 74.46 | 73.20 | 145.45 | 1.005 | 1.31 |
| Sample No. 7a | invention | W-atm | 9.8 | 2,013 | 40.67 | 39.32 | 321.12 | 1.549 | 1.29 |
| Sample No. 8 | invention | SWAP | 33.3 | 629 | 79.78 | 78.42 | 122.80 | 0.959 | 1.20 |
| Sample No. 8a | invention | W-atm | 11.2 | 1,847 | 42.12 | 41.87 | 308.94 | 1.433 | 1.19 |
| Sample No. 9 | invention | SWAP | 35.4 | 640 | 85.12 | 83.36 | 118.16 | 0.893 | 1.08 |
| Sample No. 9a | invention | W-atm | 10.6 | 1,635 | 45.35 | 44.65 | 295.24 | 1.211 | 1.05 |
| Sample No. 10 | invention | SWAP | 34.2 | 658 | 86.33 | 83.49 | 120.50 | 0.895 | 0.96 |
| Sample No. 11 | invention | SWAP | 33.8 | 669 | 85.54 | 83.57 | 122.50 | 0.923 | 0.84 |
| Sample No. 12 | comparison | SWAP | 29.6 | 698 | 78.69 | 76.16 | 158.91 | 1.098 | 0.56 |

Samples Nos. 13 to 21

Dust cores were produced in the same manner as in Sample No. 1 except that the materials shown in Table 2 were used as the soft magnetic powder, and choke coils were produced by using the dust cores.

TABLE 2

| | | Alloy composition | | | | | | | | | |
|---|---|---|---|---|---|---|---|---|---|---|---|
| | | Mn a | Si b | B c | C d | Fe | b + c | c/(a + b) | d/(a + b) | a/(b + c) | a/(c + d) |
| | | % by atom | | | | | | | | | |
| Sample No. 13 | comparison | 3.25 | 2.15 | 11.56 | 2.25 | 80.80 | 13.71 | 2.143 | 0.416 | 0.237 | 0.235 |
| Sample No. 14 | invention | 3.42 | 3.04 | 11.06 | 2.68 | 79.79 | 14.10 | 1.712 | 0.415 | 0.243 | 0.249 |
| Sample No. 15 | invention | 2.83 | 4.98 | 11.41 | 2.13 | 78.66 | 16.38 | 1.462 | 0.274 | 0.172 | 0.209 |
| Sample No. 16 | invention | 2.60 | 6.05 | 11.49 | 2.28 | 77.58 | 17.54 | 1.329 | 0.263 | 0.148 | 0.189 |
| Sample No. 17 | invention | 2.62 | 9.55 | 10.83 | 2.44 | 74.56 | 20.38 | 0.890 | 0.200 | 0.129 | 0.198 |
| Sample No. 18 | invention | 3.82 | 10.24 | 11.20 | 2.30 | 72.44 | 21.44 | 0.796 | 0.164 | 0.178 | 0.283 |
| Sample No. 19 | invention | 4.00 | 11.44 | 11.02 | 2.22 | 71.32 | 22.46 | 0.713 | 0.144 | 0.178 | 0.303 |
| Sample No. 20 | invention | 2.97 | 13.26 | 11.49 | 2.52 | 69.76 | 24.75 | 0.708 | 0.155 | 0.120 | 0.212 |
| Sample No. 21 | comparison | 3.12 | 16.45 | 11.14 | 2.15 | 67.14 | 27.59 | 0.570 | 0.110 | 0.113 | 0.234 |

| | | Atomization method | Average particle diameter μm | Oxygen content ppm | Magnetic permeability μ' 100 kHz | Magnetic permeability μ' 1,000 kHz | Iron loss Bm = 50 mT 100 kHz kW/m³ | Coercive force Oe | Saturation magnetic flux density T |
|---|---|---|---|---|---|---|---|---|---|
| Sample No. 13 | comparison | SWAP | 25.4 | 630 | 69.26 | 66.74 | 205.83 | 1.763 | 1.46 |
| Sample No. 14 | invention | SWAP | 26.3 | 546 | 74.11 | 72.39 | 160.65 | 1.463 | 1.45 |
| Sample No. 15 | invention | SWAP | 27.3 | 614 | 75.48 | 75.57 | 140.43 | 1.143 | 1.44 |
| Sample No. 16 | invention | SWAP | 21.7 | 674 | 77.15 | 75.82 | 132.85 | 1.001 | 1.42 |
| Sample No. 17 | invention | SWAP | 33.4 | 563 | 79.56 | 78.13 | 140.10 | 0.968 | 1.36 |
| Sample No. 18 | invention | SWAP | 24.5 | 527 | 80.89 | 79.49 | 112.17 | 0.876 | 1.34 |
| Sample No. 19 | invention | SWAP | 26.4 | 548 | 82.23 | 80.97 | 111.94 | 0.846 | 1.25 |
| Sample No. 20 | invention | SWAP | 33.3 | 569 | 83.34 | 81.98 | 114.98 | 0.854 | 1.15 |
| Sample No. 21 | comparison | SWAP | 32.1 | 584 | 78.16 | 76.40 | 117.59 | 0.886 | 0.98 |

Samples Nos. 22 to 30

Dust cores were produced in the same manner as in Sample No. 1 except that the materials shown in Table 3 were used as the soft magnetic powder, and choke coils were produced by using the dust cores.

TABLE 3

| | | Alloy composition | | | | | | | | | |
|---|---|---|---|---|---|---|---|---|---|---|---|
| | | Mn a | Si b | B c | C d | Fe | b + c | c/(a + b) | d/(a + b) | a/(b + c) | a/(c + d) |
| | | % by atom | | | | | | | | | |
| Sample No. 22 | comparison | 3.42 | 11.75 | 2.60 | 2.68 | 79.56 | 14.35 | 0.172 | 0.176 | 0.238 | 0.648 |
| Sample No. 23 | invention | 3.21 | 11.83 | 5.15 | 2.25 | 77.56 | 16.98 | 0.342 | 0.150 | 0.189 | 0.434 |
| Sample No. 24 | invention | 2.73 | 11.44 | 7.74 | 2.36 | 75.71 | 19.19 | 0.546 | 0.167 | 0.142 | 0.270 |
| Sample No. 25 | invention | 2.51 | 11.81 | 8.51 | 2.42 | 74.76 | 20.32 | 0.594 | 0.169 | 0.123 | 0.229 |
| Sample No. 26 | invention | 3.03 | 11.63 | 8.84 | 2.45 | 74.05 | 20.46 | 0.603 | 0.167 | 0.148 | 0.268 |
| Sample No. 27 | invention | 3.63 | 11.69 | 9.72 | 2.47 | 72.49 | 21.41 | 0.634 | 0.161 | 0.169 | 0.298 |
| Sample No. 28 | invention | 3.56 | 10.66 | 10.68 | 2.50 | 72.59 | 21.35 | 0.751 | 0.176 | 0.167 | 0.270 |
| Sample No. 29 | invention | 2.96 | 10.08 | 13.75 | 2.48 | 70.73 | 23.83 | 1.054 | 0.190 | 0.124 | 0.183 |
| Sample No. 30 | comparison | 2.80 | 10.67 | 16.47 | 2.37 | 67.69 | 27.14 | 1.222 | 0.176 | 0.103 | 0.149 |

| | | Atomization | Average particle diameter | Oxygen content | Magnetic permeability μ' | | Iron loss Bm = 50 mT 100 kHz | Coercive force | Saturation magnetic flux density |
|---|---|---|---|---|---|---|---|---|---|
| | | method | μm | ppm | 100 kHz | 1,000 kHz | kW/m$^3$ | Oe | T |
| Sample No. 22 | comparison | SWAP | 33.0 | 654 | 71.24 | 68.72 | 181.78 | 2.123 | 1.45 |
| Sample No. 23 | invention | SWAP | 31.6 | 564 | 75.06 | 73.34 | 141.62 | 1.106 | 1.45 |
| Sample No. 24 | invention | SWAP | 35.0 | 578 | 76.23 | 76.32 | 144.62 | 1.093 | 1.44 |
| Sample No. 25 | invention | SWAP | 34.0 | 601 | 77.36 | 76.03 | 145.68 | 1.082 | 1.42 |
| Sample No. 26 | invention | SWAP | 35.2 | 564 | 79.69 | 78.26 | 130.99 | 0.987 | 1.36 |
| Sample No. 27 | invention | SWAP | 34.5 | 571 | 83.56 | 82.16 | 129.67 | 0.896 | 1.34 |
| Sample No. 28 | invention | SWAP | 29.0 | 548 | 86.54 | 85.28 | 113.45 | 0.886 | 1.32 |
| Sample No. 29 | invention | SWAP | 24.6 | 631 | 88.23 | 86.87 | 118.56 | 0.896 | 1.30 |
| Sample No. 30 | comparison | SWAP | 26.6 | 654 | 84.45 | 82.69 | 122.79 | 0.912 | 0.94 |

Samples Nos. 31 to 39

Dust cores were produced in the same manner as in Sample No. 1 except that the materials shown in Table 4 were used as the soft magnetic powder, and choke coils were produced by using the dust cores.

TABLE 4

| | | Alloy composition | | | | | | | | | |
|---|---|---|---|---|---|---|---|---|---|---|---|
| | | Mn a | Si b | B c | C d | Fe | b + c | c/(a + b) | d/(a + b) | a/(b + c) | a/(c + d) |
| | | % by atom | | | | | | | | | |
| Sample No. 31 | comparison | 3.36 | 11.84 | 10.75 | 0.08 | 73.97 | 22.60 | 0.708 | 0.005 | 0.194 | 0.310 |
| Sample No. 32 | invention | 2.15 | 11.23 | 9.93 | 0.24 | 76.46 | 21.15 | 0.742 | 0.018 | 0.101 | 0.211 |
| Sample No. 33 | invention | 3.06 | 11.56 | 10.36 | 1.07 | 73.95 | 21.92 | 0.709 | 0.073 | 0.140 | 0.268 |
| Sample No. 34 | invention | 2.81 | 11.05 | 10.81 | 1.34 | 74.00 | 21.85 | 0.780 | 0.097 | 0.128 | 0.231 |
| Sample No. 35 | invention | 2.90 | 11.26 | 11.35 | 2.14 | 72.36 | 22.61 | 0.802 | 0.151 | 0.128 | 0.215 |
| Sample No. 36 | invention | 3.22 | 11.30 | 11.64 | 2.24 | 71.59 | 22.94 | 0.802 | 0.155 | 0.140 | 0.232 |
| Sample No. 37 | invention | 2.96 | 10.95 | 12.76 | 2.71 | 70.61 | 23.72 | 0.917 | 0.195 | 0.125 | 0.191 |
| Sample No. 38 | invention | 2.49 | 10.78 | 12.30 | 2.87 | 71.55 | 23.09 | 0.927 | 0.217 | 0.108 | 0.164 |
| Sample No. 39 | comparison | 3.12 | 11.12 | 12.62 | 3.89 | 69.25 | 23.75 | 0.886 | 0.273 | 0.131 | 0.189 |

| | | Atomization | Average particle diameter | Oxygen content | Magnetic permeability μ' | | Iron loss Bm = 50 mT 100 kHz | Coercive force | Saturation magnetic flux density |
|---|---|---|---|---|---|---|---|---|---|
| | | method | μm | ppm | 100 kHz | 1,000 kHz | kW/m3 | Oe | T |
| Sample No. 31 | comparison | SWAP | 28.7 | 641 | 70.23 | 67.71 | 166.43 | 1.925 | 1.36 |
| Sample No. 32 | invention | SWAP | 20.8 | 564 | 74.56 | 72.84 | 163.69 | 1.511 | 1.38 |
| Sample No. 33 | invention | SWAP | 34.4 | 612 | 75.36 | 75.45 | 143.54 | 1.121 | 1.43 |
| Sample No. 34 | invention | SWAP | 25.0 | 578 | 76.53 | 75.20 | 145.29 | 1.098 | 1.41 |
| Sample No. 35 | invention | SWAP | 25.9 | 594 | 78.88 | 77.45 | 137.73 | 1.023 | 1.37 |
| Sample No. 36 | invention | SWAP | 25.5 | 562 | 82.65 | 81.25 | 126.88 | 0.956 | 1.35 |
| Sample No. 37 | invention | SWAP | 27.6 | 601 | 84.56 | 83.30 | 120.67 | 0.912 | 1.33 |
| Sample No. 38 | invention | SWAP | 22.8 | 623 | 75.23 | 73.87 | 118.35 | 1.125 | 1.32 |
| Sample No. 39 | comparison | SWAP | 32.1 | 614 | 62.35 | 60.59 | 152.34 | 1.782 | 1.25 |

Samples Nos. 2a and 6a to 9a

Dust cores were produced in the same manner as in Samples Nos. 2 and 6 to 9 respectively except that a water atomizing method (referred to as W-atm in each table) was used instead of the spinning water atomizing method, and choke coils were produced by using the dust cores.

In the tables, the samples of the soft magnetic powder according to the embodiments of the invention are referred to as "invention", and the samples outside the scope of the invention are referred to as "comparison". These labels, however, do not limit the scope of the claims.

2. Evaluation of Soft Magnetic Powder, Dust Core and Choke Coil 2.1 Measurement of Oxygen Content of Soft Magnetic Powder The samples of the soft magnetic powder obtained in the examples and the comparative examples were measured for oxygen content with an oxygen-nitrogen analyzer (TC-136, available from LECO Corporation).

2.2 Measurement of Magnetic Characteristics of Choke Coil

The choke coils obtained in the examples and the comparative examples were measured for the magnetic permeability μ', the iron loss (core loss Pcv), the coercive force and the saturation magnetic flux density under the following measurement condition.

Measurement Condition measurement frequency: 100 kHz and 1,000 kHz maximum magnetic flux density: 50 mT measurement device: alternating current magnetic characteristics analyzer (B-H Analyzer SY8258, available from Iwatsu Test Instruments Corporation)

The evaluation results are shown in Tables 1 to 4.

As apparent from Tables 1 to 4, the choke coils obtained in the examples have a saturation magnetic flux density and a magnetic permeability that are relatively high and a coercive force that is relatively low. Therefore, the choke coils achieve both reduction of iron loss and enhancement of the magnetic characteristics.

Figure 3:
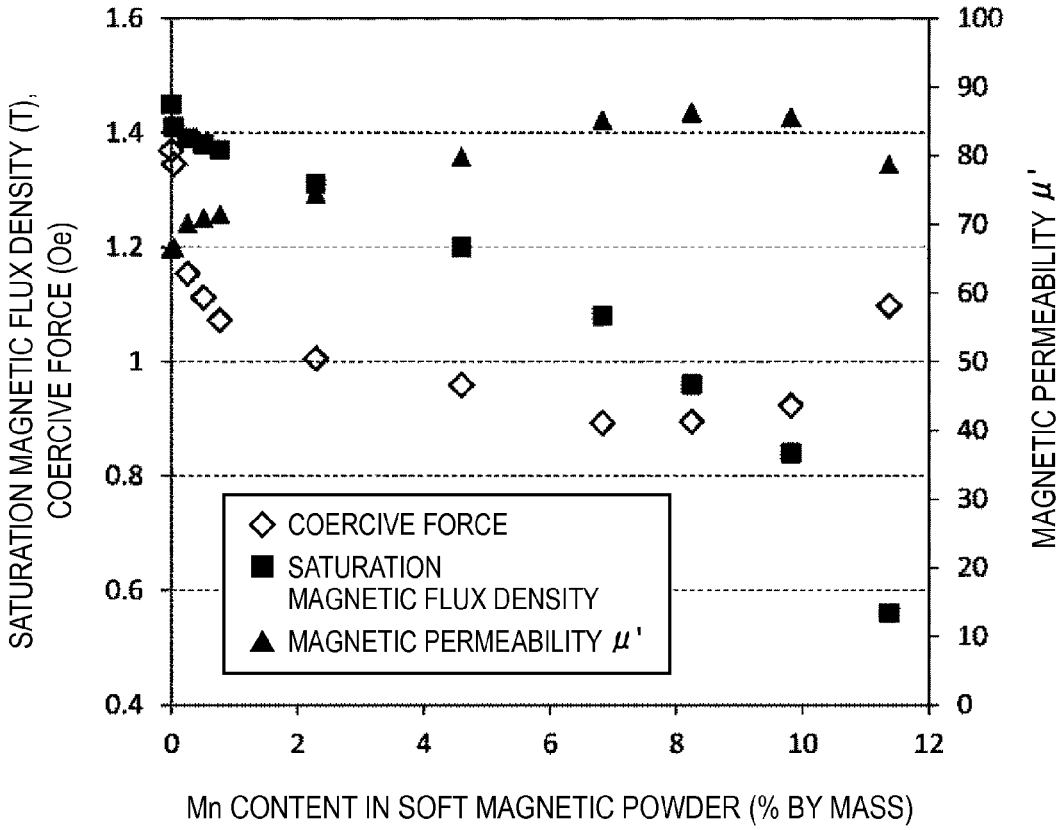
FIG. 3 is a graph showing a relationship of the saturation magnetic flux density, the magnetic permeability and the coercive force with respect to the Mn content in the soft magnetic powder shown in Table 1.

FIG. 3 is a graph showing the relationship of the saturation magnetic flux density, the magnetic permeability and the coercive force with respect to the Mn content in the soft magnetic powder shown in Table 1. As apparent from FIG. 3, the choke coils obtained in the examples achieve both reduction of iron loss and enhancement of the magnetic characteristics at a high level.

On the other hand, the choke coils obtained in the comparative examples are relatively low in at least one of the saturation magnetic flux density and the magnetic permeability or are relatively high in the coercive force. Therefore, these choke coils are difficult to achieve both reduction of iron loss and enhancement of the magnetic characteristics.

The entire disclosure of Japanese Patent Application No. 2012-083142 filed Mar. 30, 2012 is hereby expressly incorporated by reference herein.

What is claimed is:

1. A soft magnetic powder comprising an amorphous alloy material having an alloy composition represented by $Fe_{100-a-b-c-d}Mn_aSi_bB_cC_d$, wherein a, b, c and d each represent a proportion in terms of percent by atom, and satisfy $0.1 \le a \le 10$, $3 \le b \le 15$, $3 \le c \le 15$, and $0.1 \le d \le 3$.

2. The soft magnetic powder according to claim 1, wherein the amorphous alloy material satisfies relationship $0.05 \le c/(a+b) \le 1.5$.

3. The soft magnetic powder according to claim 1, wherein the amorphous alloy material satisfies relationship $6 \le b+c \le 30$.

4. The soft magnetic powder according to claim 1, wherein the amorphous alloy material satisfies relationship $0.01 \le d/(a+b) \le 0.3$.

5. The soft magnetic powder according to claim 1, wherein the soft magnetic powder has an average particle diameter of 3 to 100 μm.

6. The soft magnetic powder according to claim 1, wherein the soft magnetic powder has a coercive force of 4 Oe or less.

7. The soft magnetic powder according to claim 1, wherein the soft magnetic powder has an oxygen content of 150 to 3,000 ppm in terms of mass ratio.

8. A dust core comprising a soft magnetic powder containing an amorphous alloy material having an alloy composition represented by $Fe_{100-a-b-c-d}Mn_aSi_bB_cC_d$, wherein a, b, c and d each represent a proportion in terms of percent by atom, and satisfy $0.1 \le a \le 10$, $3 \le b \le 15$, $3 \le c \le 15$, and $0.1 \le d \le 3$.

9. A magnetic device comprising the dust core according to claim 8.

* * * * *